US012808637B2

(12) United States Patent
Huber et al.

(10) Patent No.: US 12,808,637 B2
(45) Date of Patent: Nov. 24, 2026

(54) SHELL AND ARTILLERY CHARGE

(71) Applicant: Nitrochemie Aschau GmbH, Aschau am Inn (DE)

(72) Inventors: Alexander Huber, Großkarolinenfeld (DE); Ulrich Focken, Waldkraiburg (DE); Jens Uwe Oltmanns, Waldkraiburg (DE); Andreas B. Wellm, Mühldorf am Inn (DE); Maria Anna Bachmayer, Mühldorf am Inn (DE)

(73) Assignee: Nitrochemie Aschau GmbH, Aschau Am Inn (DE)

( * ) Notice: Subject to any disclaimer, the term of this patent is extended or adjusted under 35 U.S.C. 154(b) by 0 days.

(21) Appl. No.: 18/998,367

(22) PCT Filed: Jul. 20, 2023

(86) PCT No.: PCT/EP2023/070160
§ 371 (c)(1),
(2) Date: Jan. 24, 2025

(87) PCT Pub. No.: WO2024/022944
PCT Pub. Date: Feb. 1, 2024

(65) Prior Publication Data

US 2025/0362118 A1 Nov. 27, 2025

(30) Foreign Application Priority Data

Jul. 26, 2022 (DE) ..... 10 2022 118 632.6

(51) Int. Cl.
*F42B 5/18* (2006.01)
*F42B 5/16* (2006.01)

(52) U.S. Cl.
CPC . *F42B 5/18* (2013.01); *F42B 5/16* (2013.01)

(58) Field of Classification Search
CPC .... F42B 5/16; F42B 5/18; F42B 5/181; F42B 5/184; F42B 5/38
See application file for complete search history.

(56) References Cited

U.S. PATENT DOCUMENTS 5,353,710 A * 10/1994 Eches ..... F42B 5/38 102/443
5,493,973 A 2/1996 Brion et al.
(Continued)

FOREIGN PATENT DOCUMENTS

CZ 34472 U1 * 10/2020 ..... F42C 14/00
DE 4411167 A1 10/1994
(Continued)

OTHER PUBLICATIONS

European Patent Office; International Search Report; Oct. 3, 2023; entire document.

*Primary Examiner* — Jonathan C Weber
(74) *Attorney, Agent, or Firm* — Price Heneveld LLP

(57) ABSTRACT

A shell includes a housing a stabilizing disk and an ignition tube, wherein the shell and/or the housing are combustible, wherein the shell extends in a longitudinal direction, wherein the housing includes a floor, a cover and a cleading, wherein a cavity is formed inside the shell, wherein the cavity is configured to receive propelling charge, wherein the cavity is separated by the stabilizing element into a primary subcavity and a secondary subcavity.

20 Claims, 3 Drawing Sheets

(56) References Cited

U.S. PATENT DOCUMENTS

| | | | |
|---|---|---|---|
| 2002/0124760 | A1 | 9/2002 | Brion |
| 2005/0034447 | A1 | 2/2005 | Joshi et al. |

FOREIGN PATENT DOCUMENTS

| | | | | |
|---|---|---|---|---|
| DE | 69218650 | T2 | 9/1997 | |
| DE | 60104950 | T2 | 1/2005 | |
| DE | 102007033832 | A1 | 1/2009 | |
| EP | 0410075 | A2 * | 1/1991 | ..... F42B 5/196 |
| EP | 1577634 | A1 | 9/2005 | |
| FR | 2710975 | A1 * | 4/1995 | ..... F42B 5/38 |
| JP | 2006234297 | A | 9/2006 | |

* cited by examiner

SHELL AND ARTILLERY CHARGE

BACKGROUND OF THE INVENTION

The invention relates to a shell, in particular with a pourable charge or a pourable propellant charge, and to an artillery charge, in particular with a pourable propelling charge.

Artillery charges are used to accelerate a projectile in such a way that it can be brought to the target. Therefore, the artillery charge is also responsible for the range of the projectile. In order to increase the range of the projectile, given the other parameters of a given weapon, it is therefore necessary to increase the amount of propelling charge in the artillery charge in order to increase the kinetic energy of the projectile. However, the problem with increasing the range by increasing the propelling charge quantity is that the maximum outer diameter of the artillery charge is usually limited by the gun used. Therefore, range increase is achieved by increasing the length of the shell for the artillery charge or by reducing the shell wall diameter, which in each case increases the propelling charge quantity. In practice, modular shells are usually used for artillery charges which are plugged into each other. Modular shells offer good stability, but have the disadvantage that the cover and floor collide at the contact points (double wall), which leads to a loss of the maximum available propelling charge capacity.

It is therefore the object of the present invention to increase the stability of an artillery charge or a shell for an artillery charge.

SUMMARY OF THE INVENTION

According to the invention there is a shell, advantageously the shell comprises a housing and a stabilizing element, in particular a stabilizing disk, and in particular an ignition tube, wherein the shell and/or the housing is combustible, wherein the shell extends in a longitudinal direction, wherein the housing is able to comprise in particular a floor, a cover and a cleading, wherein a cavity is formed inside the shell, wherein the cavity is designed to receive propelling charge, wherein the cavity is separated by the stabilizing element into a primary subcavity and a secondary subcavity. Alternatively or additionally preferably, the cavity can also be separated into further subcavities, in particular by further stabilizing elements. This is advantageous for stability reasons, especially for lengths of more than 1100 mm of the shell, and in some cases even necessary. Advantageously, the cavity is delimited from the surroundings at least by the floor and/or the cover in the longitudinal direction and/or by the cleading in a transverse direction. The shell serves to be arranged in a gun and to accelerate an artillery projectile, in particular an artillery shell, by the ignition of the charge or propelling charge which can be introduced or is located in the charge space or cavity, in such a way that the projectile can leave the gun and, in particular, can fly or be brought to a target area. The shell extends in the longitudinal direction. The longitudinal direction is in particular the direction in which the length of the shell is determined.

Alternatively or additionally preferred, the longitudinal direction can also be the direction in which the shell has its largest main dimension. Advantageously, the center of gravity or the volumetric center of gravity of the shell lies on the longitudinal direction. It is particularly preferred if the shell and/or the housing is formed rotationally symmetrical about the longitudinal direction, at least in sections along the longitudinal direction, in order to achieve easy handling of the shell for a soldier. Furthermore, a particularly advantageous mechanical design can also be achieved in this way, because preferably local stress peaks can be avoided or reduced as a result. Perpendicular to the longitudinal direction is in particular the transverse direction. In other words, the transverse direction can point radially away from the longitudinal direction. Advantageously, a tangential direction is perpendicular to the longitudinal direction and/or the transverse direction and/or a circumferential direction, which may also be referred to as the perimeter direction, is perpendicular to the longitudinal direction and/or the transverse direction. Expediently, the longitudinal direction, the transverse direction and the circumferential direction form a cylindrical coordinate system with each other, wherein the longitudinal direction forms the height coordinate, the transverse direction forms the radial coordinate and the circumferential direction forms the angular coordinate. The shell includes a housing for separating the interior of the shell or cavity from the environment, wherein the housing may in turn include a floor, a cover, and/or a cleading.

The individual components of the housing may each be formed by individual, in particular one-piece, elements or by several different elements. However, it is particularly expedient if the floor and/or the cover are formed integrally with the cleading or a component of the cleading, in order to achieve particularly good stabilization. The floor and/or the cover delimit the shell, in particular in the longitudinal direction, while the cleading can serve in particular to delimit the shell in the transverse direction. Advantageously, the cover is designed as a cap. Inside the housing is the cavity of the shell, wherein a charge or a propelling charge, in particular a pourable propelling charge, can be introduced into the cavity. The propelling charge serves to cause acceleration of the artillery projectile by means of an exothermic reaction. The stabilizing element, which may in particular be a stabilizing disk, of the shell is arranged within the cavity. Expediently, the stabilizing element is arranged in such a way that this mechanically connects two transversely opposite inner sides of the housing, in particular of the cleading. In other words, the stabilizing element can achieve a "direct" force transmission between two opposing components, in particular inner walls, of the shell in a manner similar to a mechanical bridging. Direct force transmission means in particular that the forces do not have to be transmitted (exclusively) via the cover or the floor, but that in addition to the floor and the cover, a force transmission is possible between opposing inner walls of the cleading via one or a plurality of stabilizing element(s). The stabilizing element therefore advantageously connects components of the cleading which are opposite to one another, in particular in the transverse direction, in particular an inner wall or inner walls. This cleading can also be referred to as a shell cleading. For this purpose, the stabilizing element or elements are fixed or fastened in particular to an inner wall of the cleading. The fixation of the stabilizing element can advantageously be done in such a way that this fixation or the fixation areas of the stabilizing element is/are circumferential around the longitudinal direction. In other words, the fixing area or the fixing surface or surfaces of the stabilizing element may form a self-contained contour which revolves around the longitudinal direction. The placement of the stabilizing element within the cavity separates the cavity into two charge subcavities, specifically the primary subcavity and the secondary subcavity. In other words, the stabilizing element therefore divides the cavity into separate subcavities, which are advantageously interconnected at most by a passage through the stabilizing element. By separating the cavity into subcavities by means of the stabilizing element, in particular damping of vibrations can be achieved and, moreover, the stiffness and mechanical stability of the shell can also be increased thereby. Expediently, the stabilizing element is a stabilizing disk. By a stabilizing disk it is understood in particular that the extension of the stabilizing disk, in particular in the transverse direction, is greater in one direction than in the direction perpendicular thereto, in particular in the longitudinal direction.

Advantageously, the shell comprises not only one stabilizing element but a plurality of stabilizing elements which are spaced apart from one another, in particular in the longitudinal direction. The features of the stabilizing element described above and below may apply in part or in full to one, to the predominant part and/or to all of the stabilizing elements. It is expedient that the smallest distance between the cover and/or the floor and the (respectively) nearest stabilizing element in the longitudinal direction is at least 5%, preferably at least 10%, particularly preferably at least 25%, and especially strongly preferred at least 30%, of the maximum extension of the shell in the longitudinal direction. In this way, a particularly high increase in stability of the shell can be achieved by the stabilizing element or elements. The shell or at least its housing is advantageously combustible. By a combustible is to be understood in particular that this component can be burned, in particular by an exothermic reaction. In particular, the shell or housing is completely combustible.

Advantageously, the shell is symmetrical or asymmetrical. A symmetrical design means in particular that at least one plane of mirror symmetry exists whose normal is parallel to the longitudinal direction. In other words, for example, the upper half of the shell can be formed mirror-symmetrically to the lower half of the shell. This allows a particularly simple and good ignition of the charge within the cavity of the shell. However, in order to simplify handling of the shell for a soldier, it can also be designed asymmetrically. An asymmetrical design means in particular that there is no plane which has a normal parallel to the longitudinal direction and to which the shell is of mirror-symmetrical design.

Advantageously, the floor and the cover are formed equally. Further advantageously, all or some, in particular two, components of the cleading are formed/made equally. In particular equally formed/made is to be understood as having the meaning that the parts are formed identically except for deviations due to manufacturing. In other words, the identical/equally formed parts can therefore—at least in thought—be mutually interchanged without causing a geometric change to the shell. In particular, this can simplify the production of the shell and/or its components, so that costs can be reduced/saved.

Advantageously, a propelling charge is introduced into the cavity, in particular also into the subcavities or the primary and/or the secondary subcavity, advantageously in pourable form, in particular in powder or granule form. By a pourable form it is to be understood in particular that the propelling charge advantageously has a maximum main dimension of preferably about 10 to about 18 mm, wherein the maximum main dimension of the propelling charge depends at the discretion of the person skilled in the art on the charge space of the weapon and bullet weight. In principle, a larger charge space and/or a higher bullet weight correlates with a higher grain size of the propelling charge. In the context of the invention, the charge space is particularly referred to as or formed by a cavity. Preferably, the diameter and length of the propelling charge are approximately the same with respect to the choice of the maximum main dimension. Alternatively or additionally preferably, a pourable shape of the propelling charge can also be understood to mean that the propelling charge is formed by solid particles without a uniform preferred direction of the main extension of the individual solid particles with respect to each other. Examples of a pourable form of the propelling charge include a charge in powder form or in granular form. The advantage of a pourable form of the propellant charge powder is, on the one hand, that it enables the shell or the artillery charge to be filled easily. In addition, however, it is precisely the use of the stabilizing element that can have a particularly positive effect on the negative stability of the artillery charge or the shell in the case of pourable propelling charges. In other words, the use of the stabilizing element according to the invention is therefore particularly advantageous for a shell with a propelling charge in pourable form.

The shell according to the invention may comprise propelling charge. The propelling charge used may comprise perforated channels.

It is also preferred that the propelling charge advantageously does not have a rod shape. By rod-shaped propelling charge, rod powder, powder with a rod shape, etc., is meant in particular propelling charge which is essentially approximately as long as the shell itself. By a powder which is essentially approximately as long as the shell is to be understood a maximum deviation of 25%, preferably of no more than 10%, from the length of the shell. Such rod powder is arranged in a bundle, i.e. along its longitudinal axis parallel to each other as well as parallel to the longitudinal axis of the shell.

It is expedient for the shell to have a length in the longitudinal direction of approx. 720 mm and/or approx. 960 mm and/or approx. 1300 mm. Especially in the case of shells of more than 700 mm, in particular if the propelling charge of the artillery charge or of the shell has a pourable form, the stability of the shell is particularly unstable or low, so that the provision of a stabilizing element, in particular in the form of a stabilizing disk, is particularly advantageous. However, if the extension in the longitudinal direction of the shell is at least 950 mm or 960 mm, this can result in a particularly good increase in the range of the projectile through the shell. In addition, if the length of the shell in the longitudinal direction is at least 950 mm or at least 1300 mm or 1380 mm, the use of stabilizing elements within the shell housing can provide particularly good mechanical stability of the shell.

Advantageously, the cleading or shell is at least in sections, preferably completely, rotationally symmetrical, in particular about the longitudinal direction. The rotationally symmetrical design of the cleading, in particular about the longitudinal direction, a particularly simple production can be achieved. In addition, the surface-to-volume ratio of the cavity, which can also be referred to as the charge space, can also be positively influenced by this, so that material can be saved as a result and, at the same time, the stability of the entire housing is also positively influenced.

Advantageously, the cleading or shell is cylindrical. Preferably, at least the cleading is designed to be completely rotationally symmetrical or at least substantially completely rotationally symmetrical. In the case of a substantially completely rotationally symmetrical design, however, some recesses and/or holes may be introduced into the cleading and/or deviations from complete rotational symmetry may be present due to manufacturing. It is particularly preferred, however, if at least partially, in particular completely, the cleading is characterized by a cylindrical shape. In other words, the cleading or the or some components of the cleading may be formed cylindrically at least in sections, in particular in sections in the longitudinal direction, preferably completely. This cylindrical formation and/or the rotationally symmetrical formation of the cleading may in particular concern the inner wall and/or the outer wall of the cleading. Due to the cylindrical design of the cleading, a particularly simple and inexpensive production can be achieved. Alternatively or additionally preferably, the cover and/or the floor is formed rotationally symmetrically, in particular about the longitudinal direction, at least in sections, preferably completely. This can in particular simplify the manufacture of the cover and/or the floor.

It is expedient that the stabilizing element is suitably fixed to the cleading, in particular to an inner wall of the cleading. This provides particularly good stabilization. The inner wall or an inner wall is the wall or wall of the cleading which forms an outer boundary of the cavity, in particular as seen in the transverse direction. The stabilizing element is fixed to the cleading in particular by means of a material bonding connection, e.g. by bonding and/or welding.

Alternatively or additionally preferred, the cover and/or the floor can also be secured to the cleading by a material bond. The use of a material bond results in particularly high mechanical strength and can also provide positive damping properties.

Advantageously, the cleading is formed in several/multiple pieces, in particular the cleading advantageously comprises a bottom cleading and a cover cleading. The bottom cleading is in particular that part of the cleading which is formed closest to the floor in the longitudinal direction, wherein the cover cleading is in particular that part of the cleading which is formed and/or arranged closest to the cover in the longitudinal direction. By forming the cleading in such a way that it is formed in multiple pieces, a simplification of the production can be achieved. In addition, stiffening can also be achieved by the multipart design of the cleading and the associated connection of the individual components of the cleading to one another, so that the stability of the shell can also be increased as a result. It is expedient to understand by a multi-piece design of the cleading that several components of the cleading are present, which in particular delimit the cavity in the transverse direction with respect to the surroundings. Advantageously, however, the cover and/or the floor of the shell do not count as a component of the cleading. It is particularly advantageous if at least some, and especially preferably all, of the components of the cleading are formed to be overlap-free with one another with respect to one of the nearest/adjacent components, especially in the longitudinal direction. By overlap-free it is to be understood in particular that the projections of the (relevant) components on the longitudinal direction do not have any overlap with each other. Due to the overlap-free formation of one or more components of the cleading with respect to the adjacent components of the cleading, a particularly material-saving production can be achieved, so that a cost-effective shell results therefrom.

It is expedient that the cleading or one or all of its components have a cleading wall thickness, wherein the cleading wall thickness may be constant, and/or wherein the cleading wall thickness is >=2 mm and/or wherein the cleading wall thickness is <=3.5 mm. By a constant wall thickness is to be understood in particular that the local wall thickness of the cleading or of the relevant component may have a maximum deviation of 10% from the averaged wall thickness of the cleading. By using a constant wall thickness of at least one, preferably the predominant, and particularly preferably all, component(s) of the cleading, a particularly cost-effective production can be achieved. Should the cleading wall thickness be >=2 mm, a particularly good increase in stability can thereby be achieved and/or at least a certain minimum degree of stability of the shell or its housing or the cleading can be achieved. If the cleading wall thickness is <=3.5 mm, this can make it particularly easy to manufacture the cleading.

Advantageously, the stabilizing element has a wall thickness, in particular a constant wall thickness, wherein the wall thickness of the stabilizing element is >=2 mm and/or wherein the wall thickness of the stabilizing element is <=3.5 mm. It is particularly preferred if the wall thickness of the stabilizing element corresponds to a wall thickness of the cleading, because this allows a particularly homogeneous mechanical strength distribution to be achieved. Therefore, local weakening of individual components and thus, for example, provision of a predetermined breaking point can be avoided or at least reduced by this. Under a constant wall thickness, with regard to the stabilizing element, the understanding already set forth for the constant wall thickness of the cleading is applicable in an equivalent manner. Should the wall thickness of the stabilizing element be >=2 mm, then at least a certain minimum degree of stability can be provided by this. However, should the wall thickness of the stabilizing element be <=3.5 mm, this can simplify production, in particular by making the stabilizing element easier to handle.

In an advantageous embodiment, at least two components of the cleading, in particular the bottom cleading and the cover cleading, are mechanically connected to one another via the stabilizing element, in particular by a material bonding connection with the stabilizing element. By connecting two components of the cleading in such a way that they are mechanically connected to each other via the stabilizing element, a particularly compact arrangement and a particularly mechanically stable connection between the bottom cleading and the cover cleading can be achieved. Advantageously, the two components mechanically connected to one another via the stabilizing element are arranged adjacent to one another in the longitudinal direction. A mechanical connection means in particular that forces can be transmitted from one component to the next component via the connecting component. The connection between the two components of the cleading and the stabilizing element can in particular be made by a material bond, wherein the material bond can advantageously be made by adhesive bonding or welding.

Preferably, the stabilizing element has a mounting area, in particular in the form of an outer stabilizing protuberance, for fixing, in particular in a planar manner, in relation to or on the cleading, wherein the stabilizing element can be limited in the transverse direction by the mounting area, and/or wherein the mounting area is formed, in particular, rotationally symmetrically about the longitudinal direction. By providing a mounting area for fixing in relation to and/or on the cleading, a particularly compact design can be achieved. Advantageously, the mounting area is fixed to an inner wall of the cleading, in particular in a materially bonded manner. This fixing can generally be in planar form, wherein a planar fixing can basically be understood to mean that the minimum dimension/main extension of the fixing area is greater than the wall thickness of the contact partners. A particularly mechanically stable fastening can be achieved by such a two-dimensional fastening.

Advantageously, the mounting area limits the stabilizing element in the transverse direction. This makes it possible to achieve a particularly compact and space-saving design of the stabilizing element.

Preferably, the mounting area is rotationally symmetrical. These features in particular result in a simple production.

Particularly preferably, the mounting area is formed as a protuberance, in particular in the longitudinal direction. This can further increase the mechanical stability of the mounting area. By a protuberance is meant in particular a region projecting from the adjacent region of the element, wherein advantageously both the adjacent region and the protuberance have the same wall thickness and/or the same material. Advantageously, the protuberance has an angle with the adjacent region or regions of substantially 90°. By an angle of substantially 90° it can be understood that the maximum deviation of the angle from 90°, may be a maximum of 20°, preferably a maximum of 15°, particularly preferably a maximum of 10°, and especially strongly preferred a maximum of 5°. Expediently, the protuberance(s) according to the invention has or have a freely tapering edge or a freely tapering end, wherein this freely tapering end is formed or extends in particular in the protuberance direction and/or in the longitudinal direction. In addition to this freely tapering edge, the protuberance in particular also has a connecting end, wherein the connecting end is connected to the adjacent region, in particular therefore the protuberance and the adjacent region are formed integrally with one another, therefore in particular forming parts of the same element. In particular, the connecting end may be formed as a rounding. Advantageously, the protuberance extends over at least three times, preferably at least five times, the material thickness or the wall thickness in longitudinal direction, which the element with the protuberance has. In other words, the dimension of the protuberance in the longitudinal direction may be at least three times, preferably at least five times, the material thickness or wall thickness of the protuberance. By providing that the mounting area is formed as a protuberance, a particularly high stability can be achieved.

In an advantageous embodiment, the mounting area extends in the longitudinal direction, and/or wherein the mounting area is tubular, in particular around the longitudinal direction. By an extension in longitudinal direction is to be understood in particular that the mounting area extends at least substantially parallel to the longitudinal direction and advantageously also in a direction perpendicular to the longitudinal direction and/or perpendicular to the transverse direction, e.g. in an orbital direction and/or tangential direction. By such an embodiment in that the mounting area extends in the longitudinal direction, a particularly compact embodiment can be achieved. By a tubular design of an element it is fundamentally to be understood in particular that the element forms a cross-section closed in itself, in particular in a sectional plane perpendicular to the longitudinal direction. In other words, in one possible embodiment, the component completely encloses the longitudinal direction. The tubular design can therefore achieve a particularly high level of stability, since local stress-increasing factors, such as in particular projections, recesses or breakthroughs, are avoided.

Advantageously, the mounting area extends at least 10 times, preferably at least 15 times, particularly preferably at least 20 times, and most preferably about 25 times, of the material thickness or the wall thickness of the stabilizing element and/or the cleading wall thickness in the longitudinal direction. In this way, a particularly good and simple possibility of two-dimensional fixation can be achieved, so that the stability of the shell can also be further increased by such an embodiment. In this context, an extension is to be understood as the projection of the relevant element or component onto the relevant direction.

Preferably, the mounting area has an extension, in particular in the longitudinal direction, of at least 50 mm, particularly preferably of at least 75 mm. The extension in the governing direction is in particular the length of the projection of the mounting area on the governing direction, therefore in particular on the longitudinal direction. Should the mounting area have an extension, in particular in the longitudinal direction, of at least 50 mm, a particularly good stabilization can be achieved by this. However, if the extension is at least 75 mm, this can simplify the assembly and handling—especially during production—of the shell.

Expediently, the ratio of the extension of the mounting area, in particular in the longitudinal direction, to the diameter of the stabilizing element or the diameter of the shell is at least 0.1. Preferably, the ratio is in a range from 0.3 to 0.5. The diameter of the stabilizing element and/or the diameter of the shell is in particular the diameter of that circle which can just surround the decisive element (stabilizing element or shell), this circle lying in particular in a plane whose normal is parallel to the longitudinal direction. Decisive for the determination of the ratio can be the maximum diameter, the minimum diameter or the arithmetic mean of the maximum and the minimum diameter. If the ratio lies in a range from 0.3 to 0.5, this allows particularly simple and advantageous assembly and stabilization of the shell.

Advantageously, the shell has an ignition tube. Particularly preferably, the ignition tube extends in the longitudinal direction. The provision of an ignition tube enables rapid and uniform ignition of the propelling charge of the artillery charge or the shell. Preferably, the ignition tube extends over at least 30%, preferably at least 40% and particularly preferably at least 50%, particularly strongly preferred at least 70%, and very strongly preferred at least 95%, of the extension of the shell in the longitudinal direction. This allows particularly uniform and rapid ignition of the propelling charge present. Advantageously, the ignition tube extends in the longitudinal direction, wherein a particularly symmetrical and uniform arrangement or spacing of the ignition tube to the propelling charge or to the charge volume of the cavity can be achieved.

In particular, the stabilizing element has an ignition tube opening, wherein the ignition tube extends or can extend through the ignition tube opening. Advantageously, the ignition tube opening may be formed through the central region, in particular in the form of an internal stabilizing protuberance, wherein the ignition tube opening may be formed through and/or surround the stabilizing protuberance. By providing an opening within the stabilizing element through which the ignition tube extends, the stability of the shell can be further increased. Advantageously, the ignition tube contacts the stabilizing element within the ignition tube opening and/or the ignition tube is fixed to the stabilizing element by a material bond, in particular within the ignition tube opening. Advantageously, the ignition tube opening has a diameter in a range between 20 and 40 mm to allow safe accommodation of the ignition tube.

In an advantageous embodiment, the diameter of the ignition tube opening to the diameter of the stabilizing element and/or to the diameter of the cleading and/or to the diameter of the centering element lies in a range from 0.12 to 0.25, preferably in a range from 0.21 to 0.23. Should the ratio lie in a range between 0.12 to 0.25, this can result in particularly good stabilization of the ignition tube and/or the shell. If, on the other hand, the ratio lies in a range between 0.21 and 0.23, this can result in particularly simple and fast assembly of the ignition tube. Within the specified limits, both good stability can be ensured and, at the same time, the ignition jet can spread very well.

Advantageously, the ignition tube opening is formed by a central region, wherein the ignition tube in particular rests against the central region, advantageously in a planar manner, and/or the wherein central region and/or the ignition tube opens in particular being rotationally symmetrical about the longitudinal direction. It may be particularly preferred if the ignition tube opening and/or the central region are formed by a protuberance. By providing a central region, particularly good stabilization and centering of the ignition tube and/or the shell can be achieved. A particularly simple production can be achieved by a rotationally symmetrical design of the central region, in particular about the longitudinal direction.

In a particular embodiment, the diameter of the ignition tube opening can be widened relative to the diameter of the ignition tube. Through this, in particular, an existing centering element can be pushed in with its central protuberance, wherein the walls in this area preferably at least partially abut one another. This is particularly preferred if the shell comprises two centering elements, one at each of its ends.

In an advantageous embodiment, the central region extends in the longitudinal direction, and/or wherein the central region is tubular, in particular around the longitudinal direction. In this context, extending in the longitudinal direction can be understood to mean that the central region extends at least substantially parallel to the longitudinal direction, and/or wherein expediently the central region also extends in a direction perpendicular to the longitudinal direction and/or perpendicular to the transverse direction, in particular in the circumferential direction and/or in the tangential direction. In this way, a particularly compact and space-saving design of the central region can be achieved. If, on the other hand, the central region is tubular, this can achieve a particularly mechanically stable design. Expediently, the central region or any tubular design of a region can in particular be of cylindrical and/or conical design at least in sections, wherein the axis of rotational symmetry of the tubular section can in particular lie on the longitudinal direction.

Advantageously, the central region has an extension, in particular in the longitudinal direction, of at least 20 to 50 mm, preferably of at least 30 to 40 mm. The extension is again to be understood as the length of the projection of the central region onto the direction of extension, in particular onto the longitudinal direction. Should the central region have an extension of at least 20 to 50 mm, this can provide particularly good stabilization of the ignition tube and/or the shell. However, if the extension is at least 30 to 40 mm, this can result in a reduced shell wall thickness and/or greater length of the shell, in particular compared with conventional shells, so that even more propelling charge can be added and/or the stability of the shell can be improved.

It is expedient that the ratio of the extension of the central region, in particular in the longitudinal direction, to the diameter of the stabilizing element and/or to the diameter of the centering element and/or to the diameter of the cleading lies in a range from 0.12 to 0.34, preferably in a range from 0.18 to 0.31. Should the ratio lie in a range between 0.12 to 0.34, a particularly good stabilization of the ignition tube and/or of the shell can be achieved by this. However, should the ratio lie in a range between 0.18 to 0.31, the assembly of the ignition tube and the manufacture of the central region can be facilitated thereby.

Advantageously, the stabilizing element is formed in one piece. By "one-piece" it is to be understood in particular that the stabilizing element or the decisive element is not formed by several components joined together. By providing that the stabilizing element is one-piece, the stability thereof can be increased and thus also the stability of the shell.

Advantageously, the stabilizing element has a connecting area, in particular in the form of a disk region or disk area, wherein the connecting area can be of planar design or flat, and/or wherein the connecting area mechanically connects the central region, which can also be referred to as the support region, to the mounting area, and/or wherein the connecting area is formed in the transverse direction between the central region and the mounting area. A planar design means in particular that the extension of the area is located between two (imaginary) planes, wherein these two planes are parallel to one another and the distance between these two planes being at most 1.5 times, preferably at most 1.3 times and particularly strongly preferably at most 1.2 times the material thickness and/or the wall thickness of the planar area. The material thickness can thereby correspond to the wall thickness if the wall is formed by a material layer. By designing the stabilizing element in such a way that the connecting area is flat, it is possible to produce the same particularly easily and tensile forces can be transmitted through the area particularly easily and reliably. By connecting the central region to the mounting area via the connecting area, a particularly compact and simple design of the stabilizing element can be achieved, so that costs can be saved as a result. The design in which the connecting area is located in the transverse direction between the central region and the mounting area also makes it possible to increase the compactness of the stabilizing element, so that even small-caliber weapons or small-caliber shells can be designed with a stabilizing element in a simple manner.

In a preferred embodiment of the stabilizing element, its centering section and/or its side protuberance extend in only one direction perpendicular to the stabilizing hole plate. In other words, the centering section and the side protuberance can extend in the same direction, in particular both in positive or negative longitudinal direction.

In an alternative embodiment of the stabilizing element, its centering section and/or its side protuberance extend in opposite directions, in particular perpendicular to the area connecting the centering section to the side protuberance. In other words, the centering section may therefore extend in the negative longitudinal direction and the side protuberance in the positive longitudinal direction or vice versa.

Preferably, the stabilizing element has gas passage openings so that gas exchange between at least two subcavities, in particular between the primary subcavity and the secondary subcavity, of the cavity, which are separated by the stabilizing element, is possible through the glass passage openings. This enables particularly good and uniform burning or homogeneous ignition of the charges or propelling charge which is/are arranged in the primary subcavity and/or the secondary subcavity. In particular, the gas passage openings can have a round, in particular elliptical, or circular cross-section in order to achieve a simple production of the same. In addition, such a design can also prevent or at least minimize the formation of cracks.

In an advantageous embodiment, the gas passage openings are arranged in the connecting area, in particular exclusively in the connecting area. This allows particularly simple production and, in addition, a particularly short extension of the gas passage openings can be achieved, so that a particularly fast and simple as well as streamlined gas exchange can take place.

Expediently, the ratio of the average diameter of the propelling charge, in particular of the propelling charge in pourable form, to the diameter of the gas passage openings is in a range from 1.1 to 3.0, preferably in a range from 1.5 to 2.5. The average diameter of the propelling charge is in particular the arithmetic mean of the largest and the smallest diameter or the main dimension of the individual charge elements or particles of the propelling charge. Advantageously, the average of 100 measurements or determinations of the arithmetic mean of the diameters is decisive for the determination of the average diameter. The diameter of the gas passage openings, on the other hand, is in particular the diameter of the smallest possible circle which can just surround the gas passage opening (individually), wherein this circle advantageously lies in a plane which is oriented perpendicular to the longitudinal direction. Should the ratio thereby lie in a range of 1.5 to 3.0, propelling charge fixation in the respective subcavity can be effected in an effective manner. However, should the ratio be in a range of 1.5 to 2.5, the fabrication of the stabilizing element and/or the gas passage openings can be simplified hereby.

Expediently, the gas passage openings run in the longitudinal direction. The course or the course direction of the gas passage openings is in particular the direction from one end of the gas passage opening to the other end of the gas passage opening. By providing that the gas passage openings run in longitudinal direction, it can be achieved that a particularly short gas passage path can be provided, so that the fluidic resistance during gas passage can be reduced.

Advantageously, the area proportion of the stabilizing element projected onto a plane perpendicular to the longitudinal direction, which is formed by the projections of the gas passage openings, lies in a range from 5% to 15%, preferably in a range from 8% to 12%, and particularly preferably in about 9% to 11%. In other words, therefore, when the stabilizing element is viewed in the longitudinal direction, 5% to 15%, preferably 8% to 12%, and particularly preferably in about 9% to 11%, of the visible areas of the stabilizing element may be formed by gas passage openings. Should the area proportion lie in a range between 5% and 15%, a particularly advantageous and simple possibility of passage of gas through the stabilizing element can thereby be achieved. If, on the other hand, the area proportion is in a range between 8% and 12%, this can result in a particularly high stability effect of the stabilizing element. A very high gas permeability combined with very good stability is achieved with an area proportion of all gas passage openings of about 9% to 11, in particular in relation to the area in which they are provided on the stabilizing element.

Advantageously, the floor, the cover and/or the cleading or one of the components of the cleading is/are made of the same material as the stabilizing element. This makes it possible to manufacture the shell in a particularly cost-effective manner. It is particularly expedient if the shell element, which has the same material as the stabilizing element, is contacted and/or connected to the stabilizing element over its surface. In this way, thermally induced stress concentrations in particular can be avoided or at least reduced. This is particularly advantageous in especially hot and/or cold areas of use, e.g. in regions with continental climates with especially strong temperature differences between summer and winter or deserts.

Advantageously, at least the floor, the cover and/or the cleading or one of the components of the cleading and/or the stabilizing element is made of nitrocellulose and/or cellulose, in particular in a ratio of 80:20 to 50:50. Optionally, the shell may comprise, preferably at least on the outer surface, a binder resin or a PU impregnation. In this embodiment, the ratio of nitrocellulose plus cellulose to binder resin plus polyurethane is preferably 95:5 to 80:20. Also preferably, a stabilizer is added in the concentration of 0.5 to 3% based on the total content of the other ingredients. Optionally, an erosion-reducing additive can also be used in a concentration of 5 to 15% additive. Such a choice of material can in particular further increase the stability of the shell.

It is expedient for the shell to have at least one centering element, in particular a centering disk, wherein the centering element is arranged in such a way that it centers the ignition tube. In this way, in particular, the exact position of the ignition tube can be better determined. Centering means in particular that the centering element supports and/or holds the ignition tube in its position, in particular at one of its distal ends. In particular, the centering element holds or centers the ignition tube in such a way that the centered section of the ignition tube, in particular one of the distal end sections of the ignition tube, lies on the longitudinal direction. The centering elements or the centering element therefore serve(s) in particular to achieve centering, in particular of the ignition tube or of a distal end of the ignition tube, of the shell. Alternatively or additionally preferred, however, the centering disks can also stabilize the shell. In order to positively influence the stability, it is advantageous if the centering disk or the centering disks are each fastened to the floor or to the cover. This fastening can be effected in particular by means of a material bond fastening.

Preferably, at least one centering element is arranged in the floor area or in the cover area. Particularly preferably, the shell has at least one centering element in the floor area and one centering element in the cover area. The cover area is in particular that region of the shell which is spaced from the cover in the longitudinal direction by a maximum of 15%, preferably a maximum of 10%, and particularly preferably a maximum of 5%, of the maximum extent of the shell in the longitudinal direction. In the same way, the floor area is in particular that area which is spaced from the floor in the longitudinal direction by a maximum of 15%, preferably a maximum of 10%, and particularly preferably a maximum of 5%, of the maximum longitudinal extent of the shell.

In an advantageous embodiment, at least one centering element has a centering section, in particular a centering protuberance, wherein the centering section is surrounded in sections by the ignition tube and/or wherein the ignition tube contacts the centering section and/or is mechanically connected to it. The centering section, in particular in the form of a centering protuberance, can further increase the stability of the shell. The centering protuberance is in particular a protuberance which extends in the longitudinal direction. Advantageously, the centering protuberance or the centering section is rotationally symmetrical about the longitudinal direction. This allows a particularly good and simple centering effect of the centering element.

Advantageously, not only one centering element has some or all of the preceding or following features, but all centering elements, in particular the centering elements in the cover area and in the floor area.

In an advantageous embodiment, the centering section has a central opening. In other words, the centering section or the centering protuberance can be continuous in the region of the centering section when viewed by itself. In this way, particularly good accessibility of the ignition tube, in particular of a distal end of the ignition tube in the longitudinal direction, can be achieved.

Advantageously, the ignition tube is secured to the centering section by a material bond, in particular with a distal end of the ignition tube in the longitudinal direction. This allows a particularly good centering and supporting effect of the ignition tube by the centering element.

It is expedient that the centering section extends in the longitudinal direction and/or protrudes in the longitudinal direction, in particular with respect to the adjacent components of the centering element. In this way, a particularly compact and space-saving design of the centering section can be achieved, which nevertheless increases the area moment of inertia.

In an alternative or additionally preferred embodiment, the projections of the centering section and the ignition tube on the longitudinal direction overlap for at least 10 mm, preferably for at least 15 mm, in the longitudinal direction. By an overlapping of the projections is to be understood in particular that the projections on the authoritative direction, in particular on the longitudinal direction, have an overlapping area. This overlapping area has, in particular in the longitudinal direction, an extension of at least 10 mm, preferably of at least 15 mm. The overlap area thus includes, in other words, the projection of both the centering section and the ignition tube. Should the overlap have a size of at least 10 mm in the relevant direction, in particular in the longitudinal direction, a particularly simple assembly can be achieved hereby. If, on the other hand, the overlap is at least 15 mm, a particularly stable mechanical connection of the ignition tube can be achieved.

Preferably, at least one centering element has a side protuberance, in particular side centering protuberance, wherein the side protuberance can extend in the longitudinal direction, wherein the side protuberance can be fixed to the bottom, the cover and/or the cleading. More suitably, the side protuberance transversely bounds the centering disk. In particular, this side protuberance can serve to secure the position of the centering element in the transverse direction, so that the side protuberance can be a side centering protuberance. By providing the side protuberance, the stability of the shell can be further increased, in particular by increasing the surface moment of inertia. In order to securely fix the side protuberance or securely fix the centering element, this should be fixed to the bottom, the cover and/or the cleading, in particular by a material bond, e.g. by welding or bonding.

In an advantageous embodiment, the projection of the side protuberance and the cleading, in particular on the longitudinal direction, overlap for at least 10 mm, preferably in a range of 20 mm to 30 mm, viewed in the longitudinal direction. If the overlap is at least 10 mm, particularly good stabilization can be achieved. If, on the other hand, the overlap should be in a range between 20 mm to 30 mm, in particular the production or assembly of the side protuberance on the cleading can be carried out in a simpler manner.

In a preferred embodiment, at least one centering element is bounded in the transverse direction by the/one side protuberance. This can achieve a particularly good increase in the stability of the centering element, because it can effectively increase the surface moment of inertia. Alternatively or additionally, the formation of cracks at the distal end in the transverse direction of the centering element can be prevented or minimized, so that this also contributes to increasing the stability of the shell and/or the centering element.

Expediently, the side protuberance extends in the longitudinal direction and/or wherein the side protuberance is formed tubularly, in particular about the longitudinal direction. By extending the side protuberance in the longitudinal direction, a particularly good mountability can be achieved, in particular the planar fixing of the side protuberance relative to the cleading and/or the cover and/or the bottom. In addition, the area moment of inertia can also be further increased as a result. If, on the other hand, the side protuberance is tubular, in particular about the longitudinal direction, this can also increase the stability, in particular by preventing cracks, so that overall the mechanical integrity or the mechanical stability of the shell can be improved by such a design.

Expediently, the ratio of the minimum distance of the stabilizing element to the floor and/or to the cover in the longitudinal direction to the maximum extension of the shell in the longitudinal direction lies in a range of 0.3 to 0.7, preferably in a range of 0.4 to 0.6. The ratios set out above may thereby relate to individual stabilizing elements, to the majority of the stabilizing elements provided and/or to all stabilizing elements. In other words, therefore, the distance in the longitudinal direction of the stabilizing element to the floor and/or to the cover may lie within a certain range. In particular, the relevant distance is the minimum or the maximum distance that an element or a component of the stabilizing element has with respect to the floor and/or the cover. Should the ratio thereby lie in a range between 0.3 to 0.7, a particularly homogeneous charge distribution can be achieved within the cavity. However, should the ratio lie in a range between 0.4 to 0.6, the stability of the shell can be further increased by this.

Preferably, the protuberances of one or all stabilizing elements and/or one or all centering elements (considered for the respective element or all elements) are formed rectified in the longitudinal direction. By rectified it is to be understood in particular that the protuberances of the respective element or component all extend in a positive direction or all extend in a negative direction. In other words, therefore, in a rectified formation, all protuberances may be directed away from the cover, for example, or all protuberances may be directed towards the cover. By forming one or more of the centering elements or one or more of the stabilizing elements in the same direction, skew bending or asymmetric loading can be reduced or prevented.

It is expedient that the mounting area of the stabilizing element has a greater longitudinal extension than the central region of the stabilizing element. This is due in particular to the fact that the mounting area of the stabilizing element is subjected to significantly greater loads than the central region. Advantageously, the ratio of the length of the central region in the longitudinal direction to the length of the mounting area in the longitudinal direction is in the range from 0.25 to 0.7. This means in particular that the mounting area can also safely provide the additional forces for supporting or centering the ignition tube.

A further aspect of the invention may relate to an artillery charge. Advantageously, the artillery charge comprises a shell as previously and hereinafter described. Advantageously, propelling charge, in particular pouring propelling charge, is present in the cavity of the shell, in particular in the primary subcavity and the secondary subcavity. In other words, the cavity, the primary subcavity and/or the secondary subcavity may be filled with propelling charge.

BRIEF DESCRIPTION OF THE DRAWINGS

Further advantages and features of the present invention will be apparent from the following description with reference to the figures. Individual features of the embodiments shown can thereby also be employed by other embodiments, unless this has been expressly excluded. Showing.

DETAILED DESCRIPTION OF THE PREFERRED EMBODIMENTS

Figure 1:
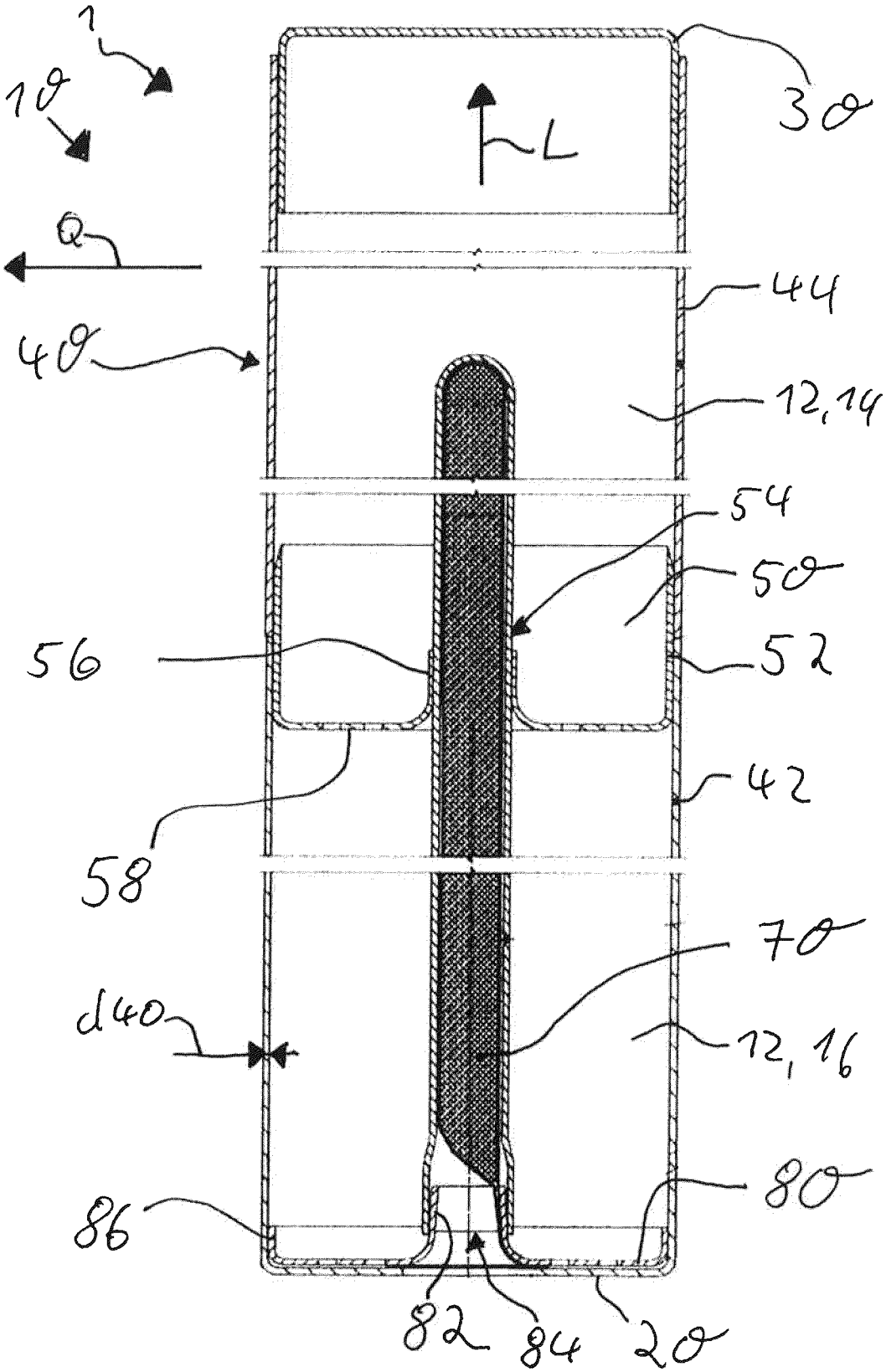
FIG. 1 is a sectional view of a shell in a sectional plane spanned by the longitudinal and transverse directions.

FIG. 1 shows a shell 1. FIG. 1 shows a sectional view, wherein the sectional plane is defined by the longitudinal direction L and the transverse direction Q. The longitudinal direction L and the transverse direction Q are perpendicular to each other.

The shell 1 comprises a housing 10, wherein the housing 10 delimits the interior or cavity 12 of the shell 1 with respect to the surroundings. The housing 10 has a floor 20 and a cover 30. The floor 20 and the cover 30 each delimit the shell 1 in the direction of the longitudinal direction L. For stability reasons, the floor 20 is formed integrally with the cleading 40. The cover 30, on the other hand, is fixed to the cleading 40, in particular to the cover cleading 44, by a material bond. The cleading 40 bounds the shell 1 in the transverse direction Q. Facing the cover 30, the cleading 40 has a cover cleading 44. The cover cleading 44 is mechanically connected to the bottom cleading 42 via the stabilizing element 50. Both the bottom cleading 42 and the cover cleading 44 have a constant cleading wall thickness d40.

The stabilizing element 50 is formed as a stabilizing disk, wherein the stabilizing element 50 is fixed in a material bonding manner to the shell 40 via its mounting area 52, which is formed as an outer stabilizing protuberance, namely both to the cover shell 44 and to the floor shell 42. The mounting area 52 extends in the longitudinal direction L and is formed as a protuberance in the longitudinal direction L, as already explained. In addition, the mounting area 52 limits the stabilizing element 50 in the transverse direction Q. In order to achieve a particularly advantageous stabilization of the shell 1, the mounting area 52 of the stabilizing element 50 is formed tubularly about the longitudinal direction L and rotationally symmetrically about the longitudinal direction L.

The stabilizing element 50 separates the cavity 12 into a primary subcavity 14 and a secondary subcavity 16.

For receiving the ignition tube 70 of the shell 1 extending in the longitudinal direction L, the stabilizing element 50 has an ignition tube opening 54. This ignition tube opening 54 is formed by or surrounded by the central region 56, which is formed as an inner stabilizing protuberance. The central region 56 is formed as a protuberance formed in the longitudinal direction L. The central region 56 supports the ignition tube 70, wherein the ignition tube 70 is fixed to the central region 56 by material bonding.

In the transverse direction Q between the mounting area 52 and the central region 56, the planar connecting area 58, which is formed as a disk region, of the one-piece stabilizing element 50 extends.

In order to achieve centering of the ignition tube 70, the shell 1 has a centering element 80 in the floor region. The centering element 80 is fixed in a material-bonding manner to the floor 20 as well as to the bottom cleading 42. In order to improve centering of the ignition tube 70, the centering element 80 has a centering section 82, which in the example presented is a centering protuberance 82. This centering protuberance 82 is also formed as a protuberance in the longitudinal direction L. In order to achieve a particularly good and precise arrangement of the centering element 80, the latter has in its distal end regions in the transverse direction Qa lateral protuberance 86, which is likewise formed as a protuberance in the longitudinal direction L. Via this lateral protuberance 86, the centering element 80 is connected to the bottom cleading 42 in a materially bonded manner, wherein the bottom cleading 42 is formed integrally with the floor 20. To facilitate ignition of the ignition tube 70, the centering element 80 has a central opening 84 which is formed in the transverse direction Q through the centering protuberance 82.

Figure 2:
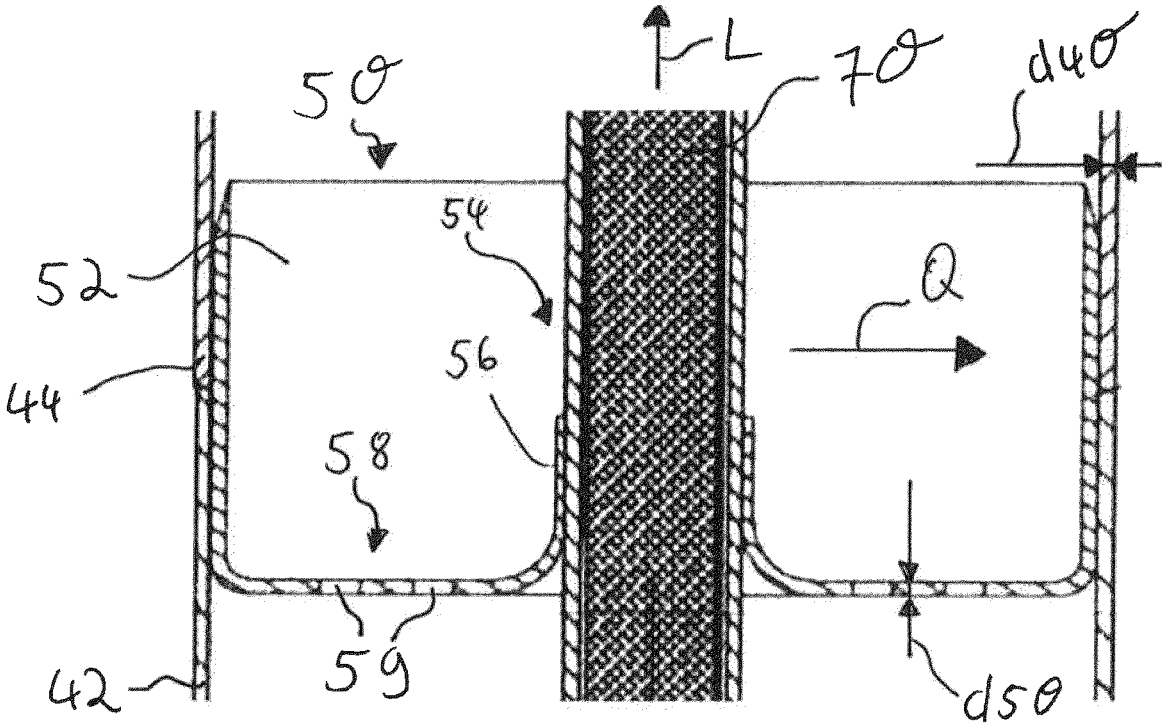
FIG. 2 is a detailed sectional view of a stabilizing element of a shell.

FIG. 2 shows a detailed view of a shell 1 in the area of the stabilizing element 50. The stabilizing element 50 has two protuberances which are formed in the same direction. This equidirectional design of the protuberances of the stabilizing element 50 is advantageously (but not exclusively) present if the stabilizing element 50 has an assembly region 52 as well as a central region 56 in the form of a protuberance in longitudinal direction L.

It is expedient that the mounting area 52 has a greater extension in the longitudinal direction L than the central region 56, as exemplified in FIG. 2.

In order to achieve a mechanical connection between the central region 56 and the mounting area 52, the stabilizing element 50 has a connecting area 58, which in the example shown is formed as a disk region. The stabilizing element 50 has a constant wall thickness d50.

In order to achieve gas passage through the stabilizing element 50, the latter has gas passage openings 59 which extend in the longitudinal direction L. Gas exchange can therefore take place through the gas passage openings 59 between two charge subspaces of the cavity 12, in particular between the primary 14 and the secondary subcavity 16.

In addition, the stabilizing element 50 also serves to provide a mechanical connection between the floor cleading 42 and the cover cleading 44, wherein both of these elements have a constant cleading wall thickness d40.

Figure 3:
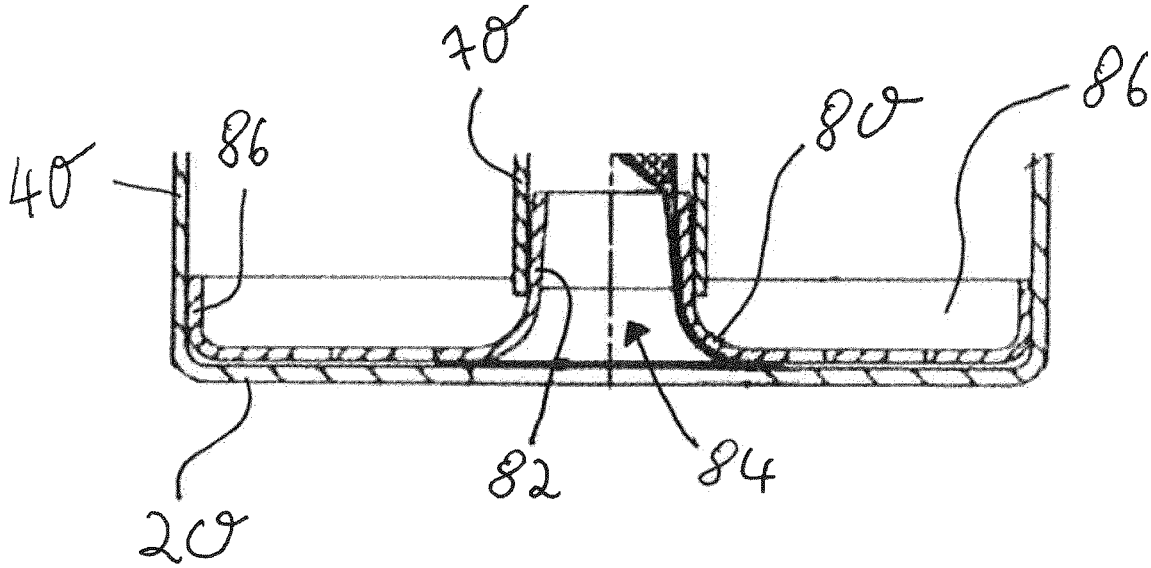
FIG. 3 is a detail of a sectional view of a centering element of a shell.

FIG. 3 shows a detailed view of the floor area of a shell 1. A centering element 80 is arranged in the floor region of the shell 1, which is characterized in the transverse direction Q by a lateral protuberance 86. In its central region, the centering element 80 has a centering section 82, wherein the central opening 84 is provided within the centering section 82.

On the outer circumference of the centering section 82 is the distal end in the longitudinal direction L of the ignition tube 70. In order to achieve a particularly mechanically resilient design, the centering element 80 is fixed to the floor 20 by a material bond. In order to facilitate ignition of the ignition tube 70, the floor 20 has an opening through which access to the central opening 84 or the interior of the centering protuberance 82 is possible from the surroundings.

Figure 4:
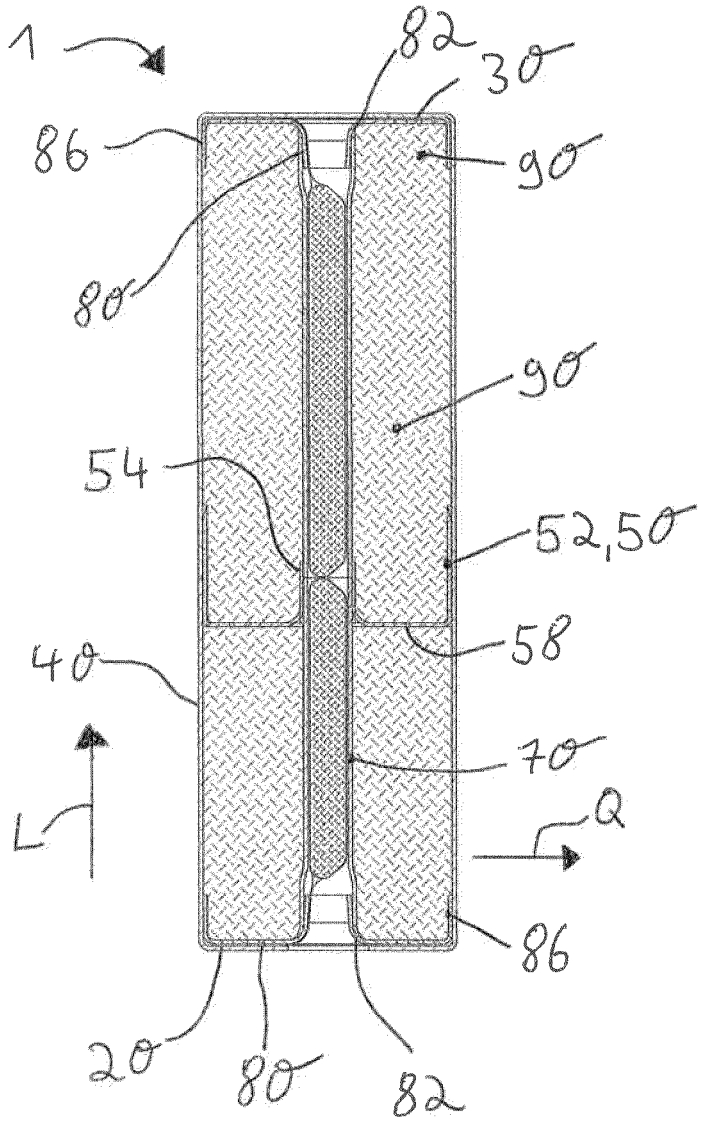
FIG. 4 is a shell with a continuous ignition tube.

FIG. 4 shows an embodiment of a shell 1 in which the ignition tube 70 is of continuous design. The ignition tube 70 is therefore connected at both distal ends, in particular in the longitudinal direction L, in each case to a centering element 80, in particular in each case to the centering section 82 of the centering element 80. The centering sections 82 extend in each case into the ignition tube 70, so that the ignition tube 70 and the centering element 80 overlap. A stabilizing element 50 is arranged between the centering elements 80, wherein the ignition tube 70 is guided through the ignition tube opening 54 of the stabilizing element 50. In order to achieve a high stability, the stabilizing element 50 is connected by a materially bond to the cleading 40 via the mounting area 52, which is formed as an outer stabilizing protuberance.

LIST OF REFERENCE SIGNS

1—Shell
10—Housing
12—Cavity
14—Primary subcavity
16—Secondary subcavity
20—Floor
30—Cover, especially cap
40—Cleading
42—Bottom cleading
44—Cover cleading
50—Stabilizing element
52—Mounting area, in particular outer stabilizing protuberance
54—Ignition tube opening
56—Central region, in particular inner stabilizing protuberance
58—Connecting area, in particular disk region
59—Gas passage opening
70—Ignition tube
80—Centering element, in particular centering disk
82—Centering section, in particular centering protuberance
84—Central opening
86—Side protuberance, especially side centering protuberance
90—Propelling charge
d40—Cleading wall thickness
d50—Wall thickness of the stabilizing element (50)
L—longitudinal direction
Q—Transverse direction

The invention claimed is:

1. A shell, comprising:
a housing;
a stabilizing element comprising a stabilizing disk; and
an ignition tube;
wherein the shell is entirely combustible;
wherein the shell extends in a longitudinal direction;
wherein the housing includes a floor, a cover, and a cleading;
wherein a cavity is formed inside the shell;
wherein the cavity is configured to receive propelling charge; and
wherein the cavity is separated by the stabilizing element at least into a primary subcavity and a secondary subcavity.

2. The shell according to claim 1, wherein the cleading or the shell is at least in sections rotationally symmetrical or cylindrical about the longitudinal direction.

3. The shell according to claim 2, wherein the stabilizing element is fixed to the cleading.

4. The shell according to claim 3, wherein the cleading is formed in multiple pieces, and wherein the cleading includes a bottom cleading and a cover cleading.

5. The shell according to claim 4, wherein the stabilizing element has a mounting area that comprises an outer stabilizing protuberance, for fixing over an area, in relation to the cleading, and wherein the stabilizing element is limited in the transverse direction by the mounting area.

6. The shell according to claim 5, wherein the mounting area is formed rotationally symmetrical about the longitudinal direction.

7. The shell according to claim 6, wherein the mounting area comprises a protuberance in the longitudinal direction.

8. The shell according to claim 1, wherein the mounting area is tubular around the longitudinal direction.

9. The shell according to claim 1, wherein the ignition tube extends in the longitudinal direction.

10. The shell according to claim 1, wherein the stabilizing element has an ignition tube opening, and wherein the ignition tube extends through the ignition tube opening.

11. The shell according to claim 10, wherein the ignition tube opening includes a central region, in particular in the form of an internal stabilizing protuberance.

12. The shell according to claim 11, wherein the ignition tube rests against the central region in a planar manner.

13. The shell according to claim 11, wherein the central region and/or the ignition tube opening is/are rotationally symmetrical about the longitudinal direction.

14. The shell according to claim 11, wherein the central region is tubular around the longitudinal direction.

15. The shell according to claim 1, wherein the stabilizing element has a connecting area in a disk area.

16. The shell according to claim 1, wherein the connecting area is flat.

17. The shell according to claim 1, wherein the connecting area mechanically connects the central region to the mounting area.

18. The shell according to claim 1, wherein the connecting area is formed in the transverse direction between the central region and the mounting area.

19. An artillery charge comprising a shell according to claim 1, wherein there is propelling change in the primary subcavity and the secondary subcavity.

20. The artillery charge according to claim 19, wherein the propelling charge comprises a pourable propelling charge.

* * * * *